US010050389B2

(12) United States Patent
Scherer et al.

(10) Patent No.: US 10,050,389 B2
(45) Date of Patent: Aug. 14, 2018

(54) FIELD-TERMINABLE TRACEABLE CABLES, COMPONENTS, KITS, AND METHODS

(71) Applicant: MERTEK INDUSTRIES, LLC, Austin, TX (US)

(72) Inventors: Christopher B. Scherer, Austin, TX (US); Jon Sholtis, Austin, TX (US)

(73) Assignee: MERTEK INDUSTRIES, LLC, Austin, TX (US)

( * ) Notice: Subject to any disclaimer, the term of this patent is extended or adjusted under 35 U.S.C. 154(b) by 458 days.

(21) Appl. No.: 14/761,491

(22) PCT Filed: Jan. 16, 2014

(86) PCT No.: PCT/US2014/011823

§ 371 (c)(1),
(2) Date: Jul. 16, 2015

(87) PCT Pub. No.: WO2014/113553

PCT Pub. Date: Jul. 24, 2014

(65) Prior Publication Data

US 2015/0340818 A1 Nov. 26, 2015

Related U.S. Application Data

(60) Provisional application No. 61/754,353, filed on Jan. 18, 2013.

(51) Int. Cl.
*H01R 13/17* (2006.01)
*H01H 47/22* (2006.01)
(Continued)

(52) U.S. Cl.
CPC ..... *H01R 13/7175* (2013.01); *H01H 47/22* (2013.01); *H01R 13/641* (2013.01);
(Continued)

(58) Field of Classification Search
CPC ..... H01R 13/7175; H01R 43/048; H01R 13/6461; H01R 43/26; H01R 13/70;
(Continued)

(56) References Cited

U.S. PATENT DOCUMENTS 3,960,428 A 6/1976 Naus et al. ..... 439/315
4,761,720 A 8/1988 Solow ..... 362/235
(Continued)

FOREIGN PATENT DOCUMENTS

CN 1331505 1/2002
CN 101572369 11/2009
(Continued)

OTHER PUBLICATIONS

Office Action issued in Chinese Application No. 201480014200, dated Jan. 16, 2017.
(Continued)

*Primary Examiner* — Jared Fureman
*Assistant Examiner* — Michael Warmflash
(74) *Attorney, Agent, or Firm* — Norton Rose Fulbright US LLP

(57) ABSTRACT

Disclosed are field-terminable traceable (e.g., networking) cables and cable components (e.g., field-applicable connection hoods), as well as related kits and methods. For example, in one embodiment of a field-applicable connection hood for a networking cable, the connection hood comprises: a connector or plug configured to be coupled to a port or outlet; two conductive tabs each configured to be coupled without, soldering to a tracer wire to enable electrical communication between the tracer wire and the conductive tab; an electrically activated telltale; and a switch configured to be actuated to enable electrical communication between the two conductive tabs and the telltale.

20 Claims, 8 Drawing Sheets

(51) Int. Cl.

| | |
|---|---|
| ***H01R 13/717*** | (2006.01) |
| ***H01R 13/6461*** | (2011.01) |
| ***H01R 43/048*** | (2006.01) |
| ***H01R 43/26*** | (2006.01) |
| ***H01R 13/641*** | (2006.01) |
| ***H01R 13/70*** | (2006.01) |
| ***H01R 24/64*** | (2011.01) |
| *H01R 9/03* | (2006.01) |
| *H01R 13/6463* | (2011.01) |

(52) U.S. Cl.
CPC ..... *H01R 13/6461* (2013.01); *H01R 13/70* (2013.01); *H01R 24/64* (2013.01); *H01R 43/048* (2013.01); *H01R 43/26* (2013.01); *H01R 9/032* (2013.01); *H01R 13/6463* (2013.01); *Y10T 29/4921* (2015.01); *Y10T 29/5193* (2015.01); *Y10T 307/826* (2015.04)

(58) Field of Classification Search
CPC .. H01R 13/641; H01R 24/64; H01R 13/6463; H01R 9/032; H01H 47/22; Y10T 29/4921; Y10T 307/826; Y10T 29/5193
See application file for complete search history.

(56) References Cited

U.S. PATENT DOCUMENTS

| | | | | |
|---|---|---|---|---|
| 4,837,488 | A | 6/1989 | Donahue | 324/66 |
| 5,159,316 | A | 10/1992 | Lazzara | 340/568.2 |
| 5,666,453 | A * | 9/1997 | Dannenmann | G02B 6/3895 385/100 |
| 5,741,152 | A | 4/1998 | Boutros | 439/490 |
| 5,764,043 | A | 6/1998 | Czosnowski et al. | 324/66 |
| 5,888,100 | A | 3/1999 | Bofill et al. | 439/676 |
| 6,002,331 | A | 12/1999 | Laor | 340/539.1 |
| 6,080,007 | A | 6/2000 | Dupuis et al. | 439/418 |
| 6,099,345 | A | 8/2000 | Milner et al. | 439/460 |
| 6,244,908 | B1 | 6/2001 | Hammond et al. | 439/676 |
| 6,280,232 | B1 | 8/2001 | Beecher et al. | 439/418 |
| 6,394,853 | B1 | 5/2002 | Hammond et al. | 439/676 |
| 6,524,128 | B2 | 2/2003 | Marowsky et al. | 439/418 |
| 6,532,328 | B1 | 3/2003 | Kline | 385/101 |
| 6,558,204 | B1 | 5/2003 | Weatherly | 439/676 |
| 6,577,243 | B1 * | 6/2003 | Dannenmann | H01R 13/641 324/66 |
| 6,710,254 | B2 | 3/2004 | Yueh | 174/135 |
| 6,790,096 | B2 | 9/2004 | Lin | 439/676 |
| 6,798,183 | B2 | 9/2004 | Bohley et al. | 324/66 |
| 6,811,445 | B2 | 11/2004 | Caveney et al. | 439/676 |
| 6,975,242 | B2 * | 12/2005 | Dannenmann | H01R 13/641 324/66 |
| 7,049,937 | B1 * | 5/2006 | Zweig | H01R 13/641 324/66 |
| 7,081,808 | B2 | 7/2006 | Colombo et al. | 398/166 |
| 7,168,994 | B2 | 1/2007 | Caveney et al. | 439/676 |
| 7,221,284 | B2 | 5/2007 | Scherer et al. | 640/815.45 |
| 7,226,217 | B1 | 6/2007 | Benton et al. | 385/89 |
| 7,299,305 | B2 | 11/2007 | Kim | 710/15 |
| 7,335,066 | B2 | 2/2008 | Carroll et al. | 439/676 |
| 7,374,458 | B2 | 5/2008 | Caveney et al. | 439/676 |
| 7,547,150 | B2 | 6/2009 | Downie et al. | 385/92 |
| 7,556,536 | B2 | 7/2009 | Caveney et al. | 439/676 |
| 7,760,094 | B1 | 7/2010 | Kozischek et al. | 340/572.1 |
| 7,772,975 | B2 | 8/2010 | Dowie et al. | 340/572.1 |
| 7,782,202 | B2 | 8/2010 | Downie et al. | 340/572.1 |
| 7,910,833 | B2 | 3/2011 | McGinley et al. | 174/112 |
| 7,910,834 | B2 | 3/2011 | McGinley et al. | 174/112 |
| 7,920,764 | B2 | 4/2011 | Kewitsch | 385/101 |
| 7,940,182 | B2 | 5/2011 | Lange et al. | 340/572.1 |
| 7,960,648 | B2 | 6/2011 | McGinley et al. | 174/36 |
| 7,965,186 | B2 | 6/2011 | Downie et al. | 340/572.1 |
| 7,972,183 | B1 | 7/2011 | Lin | 439/676 |
| 8,043,124 | B2 | 10/2011 | Caveney et al. | 439/676 |
| 8,210,755 | B2 | 7/2012 | Lavranchuk | 385/53 |
| 8,264,355 | B2 | 9/2012 | Kozischek et al. | 340/572.1 |
| 8,277,260 | B2 | 10/2012 | Caveney et al. | 439/676 |
| 8,606,972 | B2 | 12/2013 | Abuelsaad et al. | 710/16 |
| 8,611,234 | B1 | 12/2013 | Gershman | 370/251 |
| 8,702,453 | B2 | 4/2014 | Caveney et al. | 439/676 |
| 2002/0031955 | A1 | 3/2002 | Schmidt et al. | 439/676 |
| 2002/0048990 | A1 | 4/2002 | Marowsky et al. | 439/418 |
| 2003/0157842 | A1 | 8/2003 | Arnett et al. | 439/676 |
| 2003/0199192 | A1 | 10/2003 | Caveney et al. | 439/418 |
| 2003/0222786 | A1 | 12/2003 | Dannenmann et al. | 340/815.45 |
| 2003/0234729 | A1 | 12/2003 | Shen | 640/664 |
| 2004/0038564 | A1 | 2/2004 | Yan | 439/76.1 |
| 2004/0160774 | A1 | 8/2004 | Lionetti et al. | 362/253 |
| 2005/0037672 | A1 | 2/2005 | Caveney et al. | 439/692 |
| 2005/0224585 | A1 | 10/2005 | Durrant et al. | 235/492 |
| 2005/0275412 | A1 * | 12/2005 | Kwong | G01R 19/145 324/542 |
| 2006/0057876 | A1 * | 3/2006 | Dannenmann | G01R 31/041 439/173 |
| 2006/0134996 | A1 | 6/2006 | Caveney et al. | 439/676 |
| 2006/0162947 | A1 | 7/2006 | Bolouri-Saransar et al. | 174/36 |
| 2006/0232385 | A1 * | 10/2006 | Scherer | G01R 31/045 340/286.02 |
| 2007/0105453 | A1 | 5/2007 | Caveney et al. | 439/676 |
| 2007/0116411 | A1 | 5/2007 | Benton et al. | 385/53 |
| 2007/0190863 | A1 | 8/2007 | Caveney et al. | 439/676 |
| 2008/0122579 | A1 | 5/2008 | German et al. | 340/10.1 |
| 2008/0220658 | A1 | 9/2008 | Caveney et al. | 439/676 |
| 2009/0022306 | A1 | 1/2009 | Wang et al. | 379/413 |
| 2009/0269972 | A1 * | 10/2009 | Zhou | H01R 13/5845 439/460 |
| 2009/0269973 | A1 | 10/2009 | Caveney et al. | 439/460 |
| 2010/0079248 | A1 | 4/2010 | Greveling | 340/10.1 |
| 2010/0098425 | A1 | 4/2010 | Kewitsch | 398/116 |
| 2011/0043333 | A1 | 2/2011 | German | 340/10.1 |
| 2011/0116748 | A1 | 5/2011 | Smrha et al. | 385/76 |
| 2012/0058689 | A1 | 3/2012 | Caveney et al. | 439/676 |
| 2013/0039624 | A1 | 2/2013 | Scherer et al. | 385/92 |
| 2013/0052860 | A1 | 2/2013 | Caveney et al. | 439/460 |
| 2013/0164968 | A1 * | 6/2013 | Bishop | H01R 4/2433 439/404 |

FOREIGN PATENT DOCUMENTS

| | | | |
|---|---|---|---|
| CN | 102394402 | 3/2012 | |
| CN | 102859807 | 1/2013 | |
| WO | WO 2011/139341 | 11/2011 | |
| WO | WO 2011/139341 A2 * | 11/2011 | H01R 9/032 |

OTHER PUBLICATIONS

Search Report and Written Opinion issued in PCT/US2012/061967, dated Mar. 25, 2013.
Office Action Issued in Australian Patent Application No. 2012323998, dated Jun. 30, 2014.

* cited by examiner

FIELD-TERMINABLE TRACEABLE CABLES, COMPONENTS, KITS, AND METHODS

CROSS-REFERENCE TO RELATED APPLICATION

This application is a national phase application under 35 U.S.C. § 371 of International Application No. PCT/US2014/011823, filed Jan. 16, 2014, which claims priority to U.S. Provisional Patent Application No. 61/754,353, filed Jan. 18, 2013. The entire contents of each of the above-referenced disclosures are specifically incorporated herein by reference without disclaimer.

BACKGROUND

1. Field of the Invention

The present invention relates generally to cables, and more particularly, but not by way of limitation, to field-terminable traceable (e.g., networking) cables.

2. Description of Related Art

Examples of traceable networking cables are disclosed in U.S. Pat. No. 7,221,284, and U.S. Pat. No. 6,577,243.

SUMMARY

This disclosure includes embodiments of field-terminable traceable (e.g., networking) cables and cable components (e.g., field-applicable connection hoods), and related kits and methods.

Some embodiments of the present field-applicable connection hoods for a cable, comprise: a connector or plug configured to be coupled to a port or outlet; two conductive members each configured to be coupled without soldering to a tracer wire to enable electrical communication between the tracer wire and the conductive tab; an electrically activated telltale; and a switch configured to be actuated to enable electrical communication between the two conductive members and the telltale.

In some embodiments of the present field-applicable connection hoods, the switch is further configured to be actuated to disable electrical communication between the two conductive members and the telltale if the telltale is active. In some embodiments, the telltale is configured to emit an audio or visual signal if activated. In some embodiments, the telltale comprises one or more items selected from the group consisting of: a light emitting diode, an incandescent light bulb, and a liquid crystal visual indicator. In some embodiments, the switch is configured to be manually operated. In some embodiments, further comprising: a boot carrying the conductive members, the telltale, and the switch, the boot configured to be coupled to the plug or connector. In some embodiments, the boot is configured to be coupled to the plug or connector after the two conductive members are each coupled to a different conductor wire. In some embodiments, the two conductive members each comprises a tab with a slot configured to cut through an insulating layer of the tracer wire to contact a conductive core of the tracer wire such that the tracer wire can be coupled to the conductive tab without first stripping the insulating layer from the tracer wire. In some embodiments, the switch is biased toward a closed position. In some embodiments, the plug or connector comprises an RJ45 plug.

Some embodiments of the present field-applicable connection hoods further comprise: a separator mechanism configured to separate at the plug or connector at least one of a plurality of conductors in a cable from at least one other of the plurality of conducts to prevent crosstalk between the separated conductors. In some embodiments, the separate is configured to it at least partially within the plug or connector.

Some embodiments of the present field-applicable connection hoods further comprise: an electric circuit element configured to electrically couple the two conductive members and the telltale responsive to the switch being operated. In some embodiments, the electric circuit element is configured to electrically couple the two conductive members and the telltale for a prescribed amount of time. In some embodiments, the electric circuit element is configured to be powered through the tracer wires. In some embodiments further comprise: a battery coupled to the electric circuit element; where the electric circuit element is configured to electrically couple the two conductive members to the battery. In some embodiments, the electric circuit element is configured to electrically coupled the telltale and the two conductive members to the battery.

Some embodiment of the present field-applicable connection hoods further comprise: a controller configured to enable electrical communication between the two conductive members responsive to the switch being operated. In some embodiments, the controller is configured to periodically enable electrical communication between to the two conductive members. In some embodiments, the controller is configured to be powered through the tracer wires. Some embodiments further comprise: a battery coupled to the controller; where the controller is configured to electrically couple the two conductive members to the battery. In some embodiments, the controller is configured to electrically coupled the telltale and the two conductive members to the battery. In some embodiments, the controller is configured to: enable electrical communication between the two conductive members through the battery responsive to the switch being operated if electrical communication is not already enabled; and interrupt electrical communication between the two conductive members through the battery responsive to the switch being operated if electrical communication is already enabled. In some embodiments, the controller is configured to interrupt communication through the battery between the two conductive members if a separate circuit between the two conductive members is interrupted.

Some embodiments of the present cables comprise: a cable having a plurality of conductors and two tracer wires; a first one of the present connection hoods coupled to a first end of the cable with the two connective members each coupled in electrical communication with a different one of the two tracer wires; and a second one of the present connection hoods coupled to a second end of the cable with the two connective members each coupled in electrical communication with a different one of the two tracer wires. In some embodiments, the first connection hood includes a controller, and the second connection hood does not include a controller. In some embodiments, the first connection hood includes a controller, and the second connection hood includes a controller.

Some embodiments of the present kits comprise: a plurality of first connection hoods; a plurality of second connection hoods; and a length of cable without connection hoods, the cable having a plurality of conductors and two tracer wires. Some embodiments of the present kits further comprise: a crimper configured to crimp at least a portion of the plug or connector onto the plurality of conductors. In some embodiments, the first connection hoods each includes a controller, and the second connection hoods each does not include a controller. In some embodiments, the first connection hoods each includes a controller, and the second connection hoods each includes a controller.

Any embodiment of any of the present cables, systems, apparatuses, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DESCRIPTION OF ILLUSTRATIVE EMBODIMENTS

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system or apparatus that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Further, a structure (e.g., a component of an apparatus, such as a cable) that is configured in a certain way is configured in at least that way, but it can also be configured in other ways than those specifically described.

Figure 1:
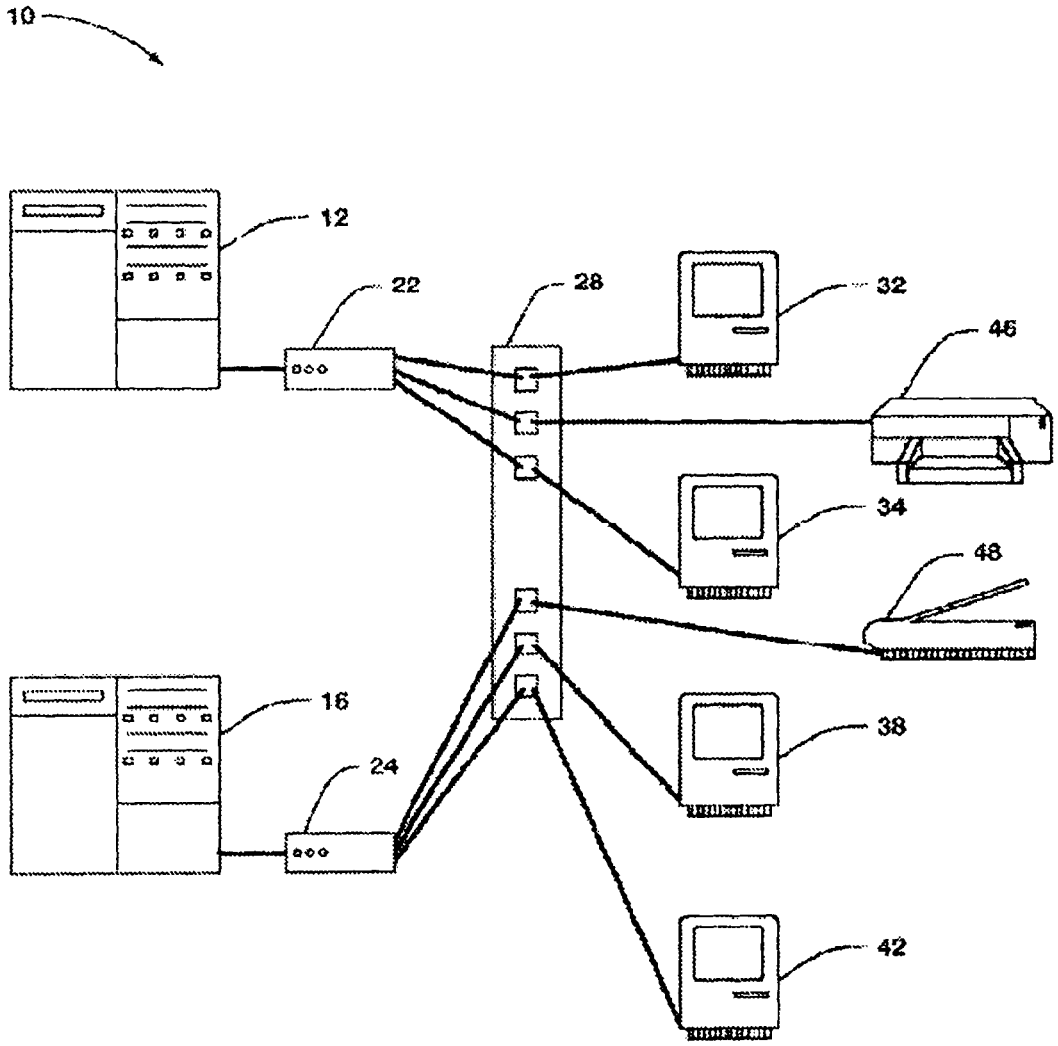
FIG. 1 is a schematic view of a networked computer environment.

Referring now to the drawings, and more particularly to FIG. 1, shown and designated by reference numeral 10 is an example of a networked environment that includes servers, computers, hubs, peripheral devices, and a cable panel. In the example, shown computers 32, 34, 38, and 42 are each connected by networking cables to a cable panel 28. The computers can be at multiple locations. Also attached to panel 28 by networking cables are peripheral devices such as printer 46 and scanner 48. Panel 28 is often located at a central room where service personnel can access it. From panel 28, multiple computers and peripheral devices are often linked by networked cables to hubs such as 22 and 24, which may be connected to servers 12 and 16. Multiple servers and hubs may be housed in a room. Various protocols (e.g., Ethernet) can be used to support data transfer between computers and servers. The example shown is relatively a small network, and networks may often be much larger. In addition to the devices shown in FIG. 1, networks can include, for example, other electronic devices such as workstations, switches, tape drives, storage devices, telephone switches, VOIP devices, routers, and/or any other device that may be connected to a network (e.g., a camera). With large networks, the total number of networking cables may be very large, and routine maintenance functions (e.g., the addition or change of computers) can require significant time and manpower to trace connections throughout the network.

In some embodiments, panel 28 may also represent an external power source that provides power to the various devices (32 34, 36, 38, 42, 46, 48), and at least some of the cables extending between the various devices and panel 28 may comprise power cables (e.g., AC power cables).

Figure 2:
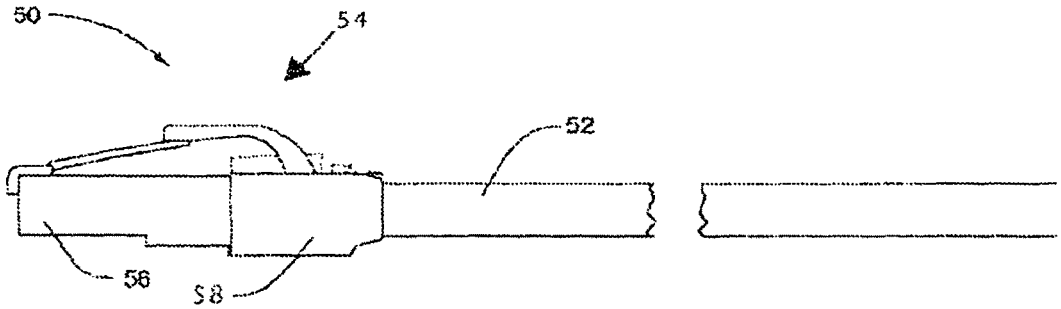
FIG. 2 is a side view of an end of a networking cable having an embodiment of the present field-applicable connection hoods.

FIG. 2 depicts an embodiment 50 of the present field-terminated traceable networking cables that may be used in the networked environment of FIG. 1. Cable 52, as used in networking applications, is typically composed of a plurality of insulated twisted conductor wire pairs encased in a flexible outer sheath (e.g., an outer cover sheath). The number of twisted conductor wire pairs (e.g., four conductor pairs with eight conductor wires, five conductor pairs with then conductor wires, etc.) can vary depending on the application. In the embodiment shown, a connector/connection assembly or hood 54 comprises a connector or plug 56 coupled to a boot 58, and the connector hood is coupled to an end of cable 52. Connector or plug 56 is configured to be coupled to an outlet or port. An example of a typical connector 56 used for Ethernet networking applications is an RJ-45 or 8P8C connector, an eight-wire or eight-pin connector commonly used in networking computers. Another example of a connector 56 that may be used is an RJ-50 or 10P10C connector, a ten conductor or ten-pin connector. Boot 58 may, for example, be overmolded onto connector 56 and/or cable 52. The overall connecter (connector or plug, and boot) will be referred to as the connector or connection hood in this description and in the appended claims. In the embodiment shown, connector hood 54 is configured to be field-applicable to cable 52 (i.e., to be connectable to cable 52 using a hand tool or portable tool).

Some well known standards for networking cables that may be included in cable 52 include Categories: 5 (which generally includes four insulated twisted copper wires encased in a flexible outer jacket layer), 5A, 5E, 6 (e.g., for Gigabit Ethernet and/or other network protocols). Later standards (e.g., Cat-6) are often backward compatible with earlier standards (e.g., CAT 5, CAT 3). Relative to Cat-5, Cat-6 specifications are generally more stringent for cross-talk and system noise. Cat-6, for example, provides performance of up to 250 MHz, and may be suitable for 10BASE-T, 100BASE-TX (Fast Ethernet), 1000BASE-T/1000BASE-TX (Gigabit Ethernet) and 10GBASE-T (10-Gigabit Ethernet). Cat-6 has a relatively lower maximum length when used for 10GBASE-T. Cat-6A cable, or Augmented Cat-6, is characterized for 500 MHz and has further improved alien crosstalk characteristics, allowing 10GBASE-T to be run for the same maximum cable length as other protocols. Several other standards are in use, and may be used in embodiments of the present traceable networking cables. In some embodiments, one or more (e.g., two in a conductor wire pair) additional conductor wires (which may be referred to as tracer wires or indicator wires) can be added to or included in a networking cable (e.g., a Cat-5 or Cat-6 cable) such that the additional conductor wire(s) are used in the tracing function described herein. For example, the use of a cable 52 with ten wires or conductors with eight-wire RJ-45 connectors allows one of the five conductor-wire pairs to be used as a continuous continuity path between electrically activated telltales (e.g., fight) at the end of the cable. Cables, conductor wires, conductor wire pairs, and/or conductors in the present embodiments may be coaxial, twin-axial, twisted, untwisted, shielded, unshielded, and/or bonded, as is known in the art.

Figure 3:
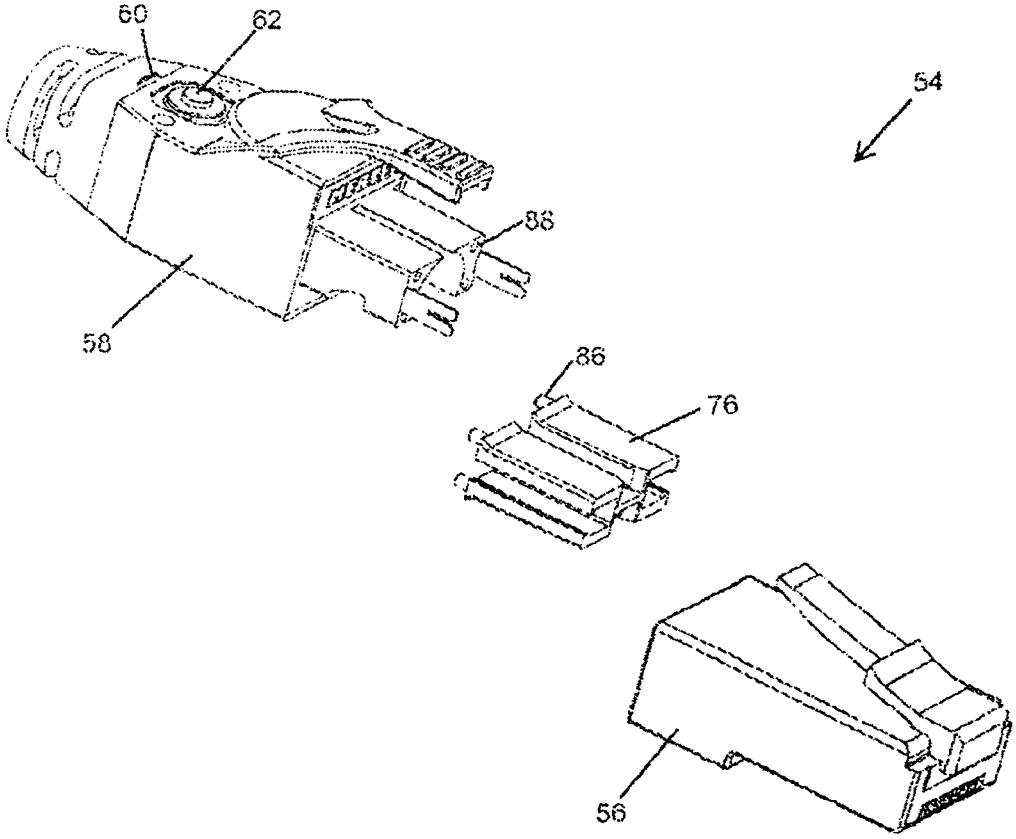
FIG. 3 is an exploded perspective view of an embodiment of the present field-applicable connection hoods that includes a boot, a plug, and a separator.
Figure 4:
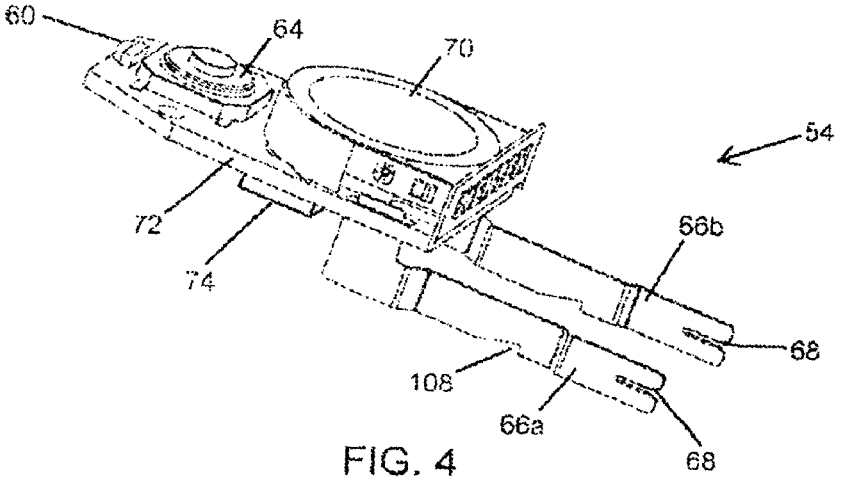
FIG. 4 is a cutaway perspective view of a first (e.g., master) version of the connection hood of FIG. 3.

FIG. 3 depicts an exploded view of connector/connection assembly or hood 54, and FIG. 4 depicts a cutaway portion of a first (e.g., master) version of hood 54 in which plug 56 and an overmolded body portion of boot 58 are omitted. In the embodiment shown, hood 54 comprises an electrically activated telltale 60 (which can be configured to produce a visual and/or an audio signal) incorporated into hood 54 (e.g., into boot 58. In the embodiment shown, telltale 60 is incorporated into a rear or proximal end of boot 58 near the cable. As used in this disclosure and the claims, an electrically activated telltale is any electrically triggered device that emits a visual or audio signal that can be detected by a human. One example of a suitable telltale is a light emitting diode (LED), but may alternatively or additionally include one or more other visual indicators (e.g., an incandescent or conventional light bulb, a liquid crystal visual indicator, etc.). In the embodiment shown, hood 54 also includes a button 62 that is configured to be manually pressed to engage a manual switch (64). In the embodiment shown, hood 54 also includes to conductive members (e.g., tabs 66*a*, 66*b*) coupled to switch 64 such that the switch is configured to be actuated to enable electrical communication between the two conductive members. In this embodiment, conductive tabs 66*a*, 66*b* are each configured to be coupled without soldering to a tracer wire (92*a*, 92*b* to enable electrical communication between the tracer wire and the conductive tab. For example, in the embodiment shown, conductive tabs 66*a*, 66*b* each comprises a slot 68 configured to cut through an insulating layer of the tracer wire to contact a conductive core of the tracer wire such that the tracer wire can be coupled to the conductive tab without first stripping the insulating layer from the tracer wire.

In the embodiment shown, hood 58 further comprises a battery 70, and switch 64 is configured to activate telltale 60 by initiating electrical communication between the battery and the telltale. For example, the switch can complete an indicator circuit that includes an LED to cause the LED to flash repeatedly for a predetermined time. Telltale 60 and button 62 are shown in one suitable configuration relative to hood 54; in other embodiments, telltale 60 and/or button 62 can be incorporated at any suitable position in hood 54. In the embodiment shown, hood 54 comprises a printed circuit board (PCB) 72 to which switch 64 is coupled, and a controller 74 (e.g., integrated circuit) configured to have at least some of the functionality described in this disclosure. In the embodiment shown, PCB 72 is coupled (e.g., such that an electrical connection or circuit can be completed through PCB 72) to battery. PCB 72 can be configured to include (e.g., via one or more appropriate conductive traces) a complete and/or completable (e.g., via switch 64) electrical circuit between telltale 60, switch 64, battery 70, and controller 74. A variety of batteries can be used for embodiments of the present cables. For example, for the circuit components discussed above, a CR927 lithium or other 3-volt battery can be used. A number of similar batteries are available from a variety of manufacturers, and any battery can be used that permits the functionality described in this disclosure.

In various embodiments of the present connection hoods, the controller can be configured to include various functions. In some embodiments, the controller is configured to: activate the telltale for a predetermined amount of time (e.g., equal to, greater than, or between any of: 10, 15, 20, or 30 seconds) responsive to the switch being operated if (or when) the telltale is not active; and inactivate (or stop activation of) the telltale responsive to the switch being operated if the telltale is activated (e.g., during the predetermined amount of time during which the telltale is activated). In some embodiments, the controller is configured to: activate the telltale for a first predetermined amount of time (e.g., equal to, greater than, or between any of: 10, 15, 20, or 30 seconds) responsive to the switch being operated in a first manner (e.g., depressed and released once) if the telltale is not active; and activate the telltale for a second predetermined amount of time (e.g., equal to, greater than, or between any of: 30, 40, 50, or 60 seconds) responsive to the switch being operated in a second manner (e.g., depressed and released twice within 2 seconds, depressed and held down for 2 seconds or more, etc.) if the telltale is not active. In such embodiments (in which the controller is configured to activate the telltale for one of two predetermined periods of time depending on the manner in which the switch is operated), the circuit may include multiple timing resistors (136), as described below. In some embodiments, the controller is configured to activate the telltale (e.g., differently than the way in which the telltale is activated responsive to the switch being operated) if the voltage of the battery falls below a threshold voltage (e.g., 1.8V for a 3V battery). For example, in some embodiments, the controller is configured to turn the telltale on continuously, or to pulse the telltale intermittently at a rate that is slower than the rate at which the telltale is pulsed responsive to operation of the switch, if the battery voltage falls below the threshold voltage.

In some embodiments, a controller or integrated circuit is used that provides several options for an end user. For example, an integrated circuit can be configured to activate the telltales to a) flash for 20 seconds responsive to a button being pushed once, and then shut off automatically, b) flash for 40 seconds responsive to a button being held down for 3 seconds, and then shut off automatically, c) shut off responsive to a button being pushed once on either end while the telltales are active, and d) flash indefinitely responsive to a button being pressed 3 times in a row, and shut off responsive to a button being pushed once.

At least some embodiments of the present field-terminated cables will include two of the present connection hoods (e.g., with one controller a "master" and one controller a "slave," or with a single controller and/or a single battery between both connection hoods. In some such embodiments, an indicator circuit includes a tracer wire pair that runs the complete length of the cable and in electrical communication with the switches and telltales of both connection hoods. In some embodiments, the present networking cables include hood 54 of FIG. 2, on a first or "left" end of the networking cable, and a second hood (e.g., similar to hood 54) on the second or "right" end of the cable (e.g., such that the two hoods are in electrical communication connection with each other via a tracer wire and/or tracer wire pair). For example, in an embodiment with a connector hood at each end of the cable, where each connector hood includes a switch and a telltale, the operation of either switch can activate both telltales if the telltales are not activated, or the operation of either switch can deactivate both telltales if the telltales are activated, as described in more detail below. In other embodiments, the controller is configured to activate only a telltale on an opposite end of the cable. For example, in embodiments with two master connection hoods, the controllers can be configured to apply a voltage to conductive tabs 66*a*, 66*b* to activate the telltale at the opposite end of the cable, but not activate the local telltale of the connection hood on which the button is depressed.

Figure 5:
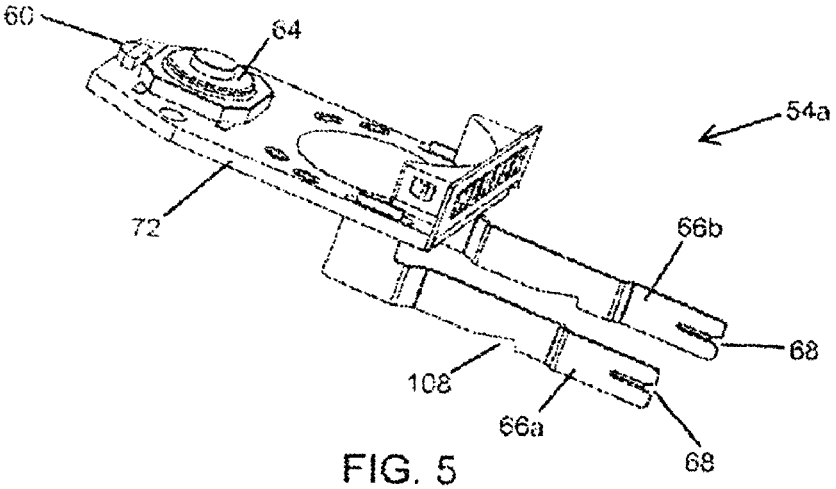
FIG. 5 is a cutaway perspective view of a second (e.g., slave) version of the connection hood of FIG. 3 with the plug, separator, and an outer portion of boot omitted.

In some embodiments, the cable includes a single controller and a single battery in a first (e.g., master) one of the two connection hoods, but includes a switch and telltale in each of the two connection hoods, such that depressing a switch at either end of the cable activates the telltales at both ends of the cable. In such embodiments, a similar PCB may be used in the hood without a controller or power source to provide the circuit between the switch and telltale. For example, FIG. 5 depicts a slave version 54*a* of a connection hood that is similar to connection hood 54 of FIG. 4, but omits battery 70 and controller 74. In this embodiment, conductive tabs 66*a*, 66 of slave connection hood 54*a* are configured to be coupled to tracer wires that are also coupled to conductive tabs 66*a*, 66*b* of master connection hood 54 such that telltale 60 and switch 64 of slave connection hood 54*a* are included in an indicator circuit with (and powered by) battery 70 of master connection hood 54. In such embodiments, controller 74 is configured such that depression of button 62 of either of the slave or master connection hoods will activate the telltales 60 of both connection hoods; or, if the telltales are active, will interrupt activation of the telltales. Thus, in such embodiments, either button (and corresponding switch) can activate or deactivate the indicator circuit (e.g., via the single controller in master connection hood 54). In other embodiments, a slave version of the present connection hoods can include a battery but not a controller, and a corresponding master version of the present connection hoods can include a controller but not a battery such that the controller of the master connection hood is configured to be powered by the battery of the corresponding slave connection hood.

Figure 6:
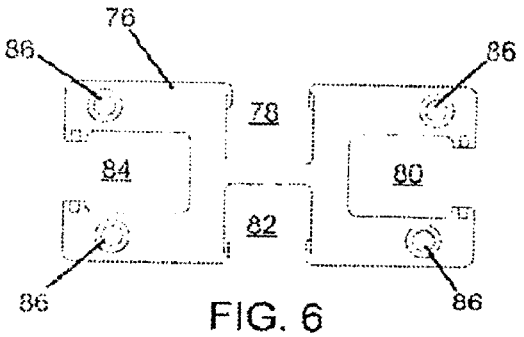
FIG. 6 is a rear end view of a separator of the connection hood of FIG. 3.

FIG. 6 illustrates an embodiment 76 of a separator for reducing crosstalk between conductor wire pairs. In the embodiment shown, separator 76 is sized to fit completely within connector hood 54 or 54*a* (and within plug 56). Separator 76 can comprise (e.g., can be molded from) a non-conductive material, and can include a plurality of channels 78, 80, 82, and 84 each for a different one of four conductive (e.g., twisted) wire pairs (e.g., from cable 52). In the embodiment shown, separator 76 is configured to maintain separation between wire pairs through the length of plug 56. In the embodiment shown, separator 76 is configured to meet the requirements for minimal crosstalk required by Cat-6 and/or Cat-6A standards. In the embodiment shown, separator 76 further includes a plurality of projections 86 configured to extend into corresponding openings 88 in boot 58 to maintain alignment of separator 76 relative to boot 58.

Figure 7A:
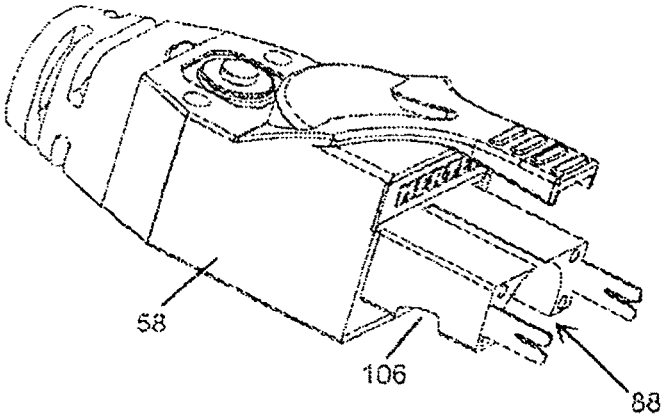
FIGS. 7A-7G are various views illustrating the application of the field-applicable connection hood of FIG. 3 to a networking cable.
Figure 7B:
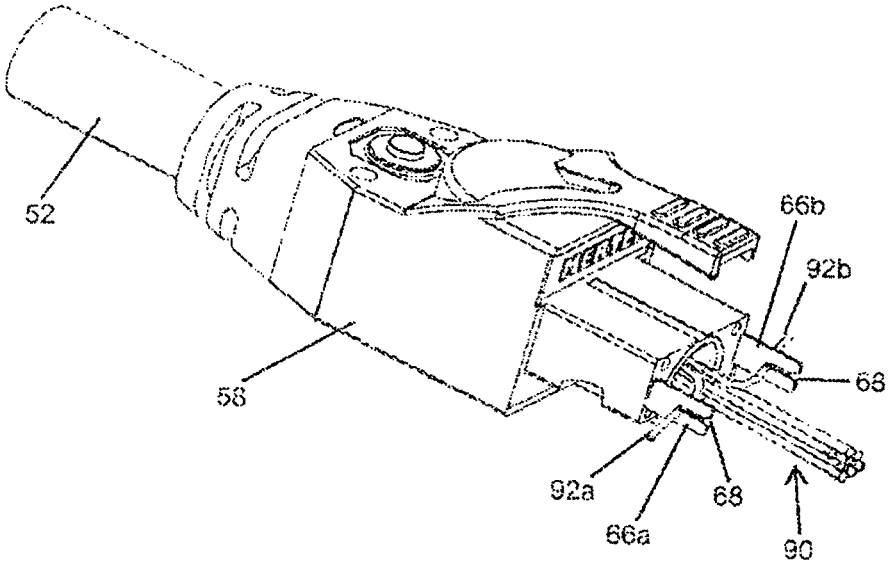
Figure 7C:
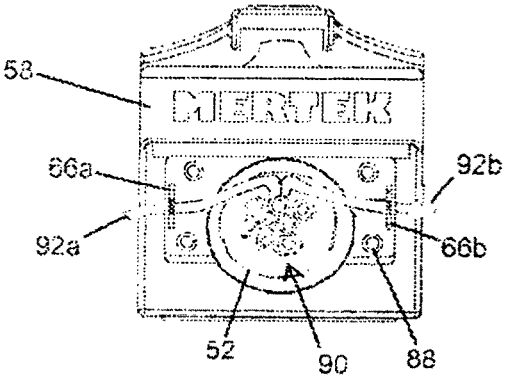

FIGS. 7A-7G are various views illustrating the application of the field-applicable connection hood of FIG. 3 to a networking cable. As shown, boot 58 includes a central passage 88. As will be appreciated by those of ordinary skill in the art, typical networking cables used with RJ45 plugs include eight (four pairs of) insulated conductors 90. In the embodiment shown, cable 52 includes an additional tracer pair of insulated conductors 92*a*, 92*b*, which may be referred to herein as tracer wires. In the embodiment shown, an outer insulation layer 94 of cable 52 is stripped away from end 96 of the cable without removing the insulating layers of the respective conductors 90 and tracer wires 92*a*, 92*b*, and end 96 of cable 52 is inserted through passage 88, as shown in FIGS. 7B-7C. Tracer wire 92*a* can then be pressed into slot 68 of conductive tab 66*a*, and tracer wire 92*b* can be pressed into slot 68 of conductive tab 66*b*, such that each conductive tab cuts through the insulating layer of the respective tracer wire to contact the conductive core. For example, if conductive tabs 66*a*, 66*b* are configured to be used with 24 gauge tracer wire, then the slots 68 can have a width that is equal to or slightly (e.g., 1%-10%) smaller than the diameter of the 24-gauge conductive core and/or the inner edges that define slot 68 may be formed with an edge to facilitate cutting through the outer insulating layer of the tracer wire. In other embodiments, a portion of the outer insulating layer of each tracer wire may be removed and the conductive core wrapped around or otherwise coupled in electrical communication with conductive tabs 66*a*, 66*b* (or other conductive structures such as pins).

Figure 7D:
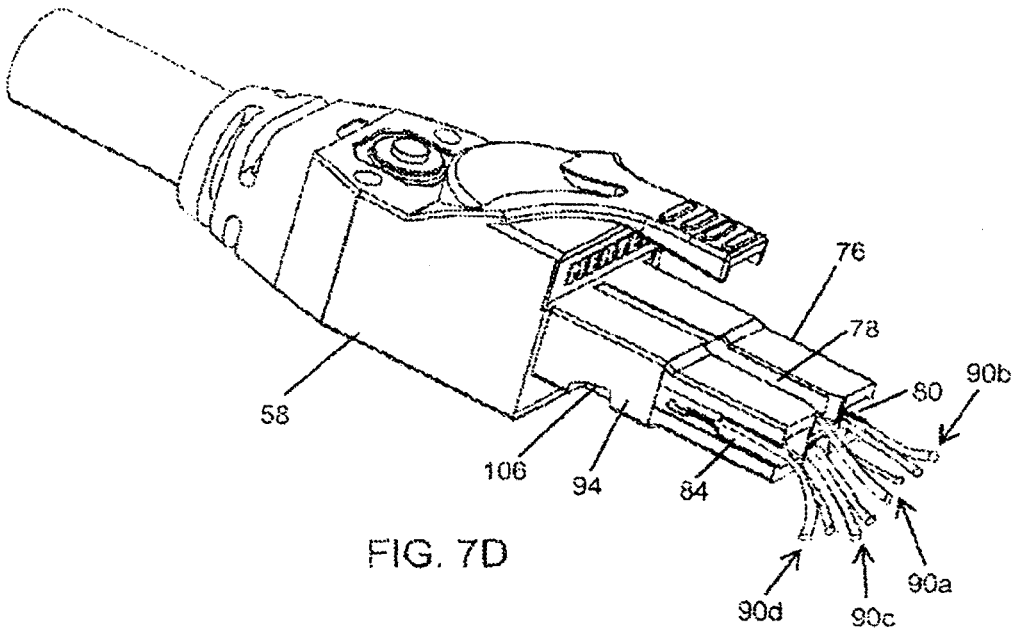
Figure 7E:
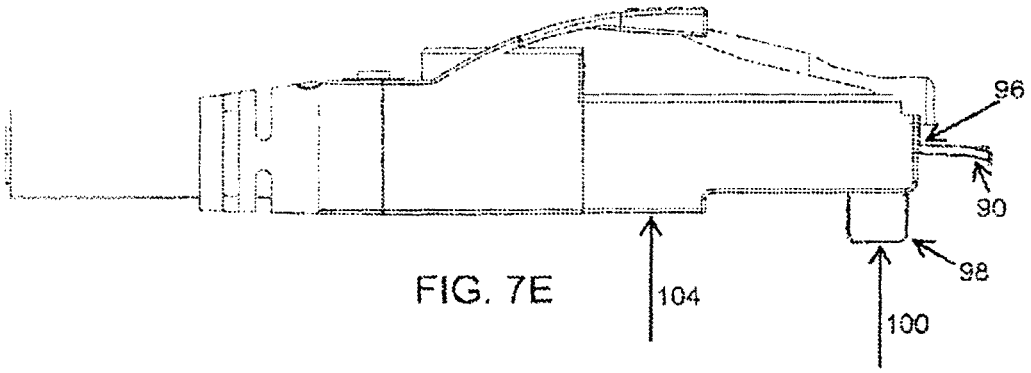
Figure 7F:
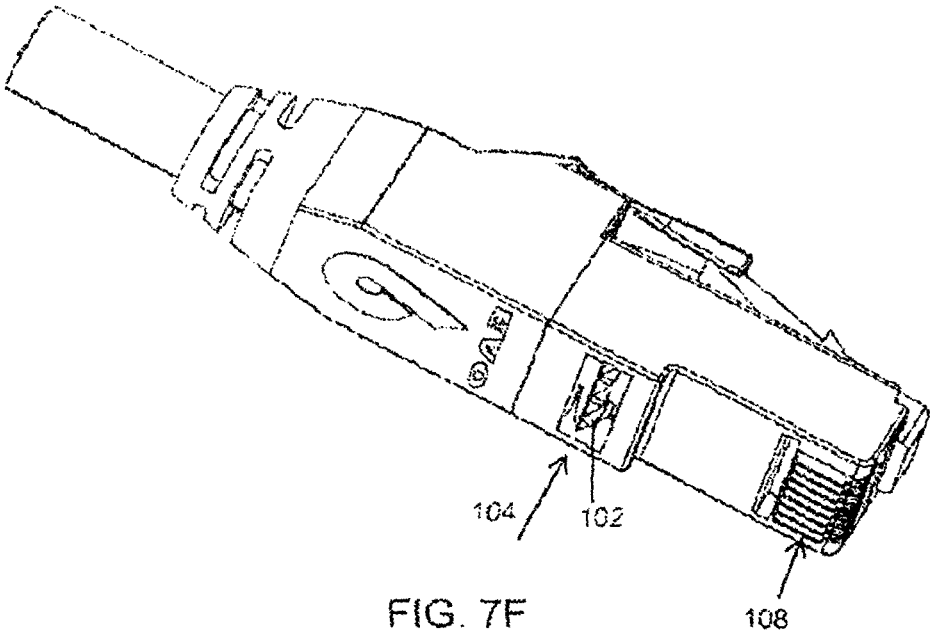
Figure 7G:
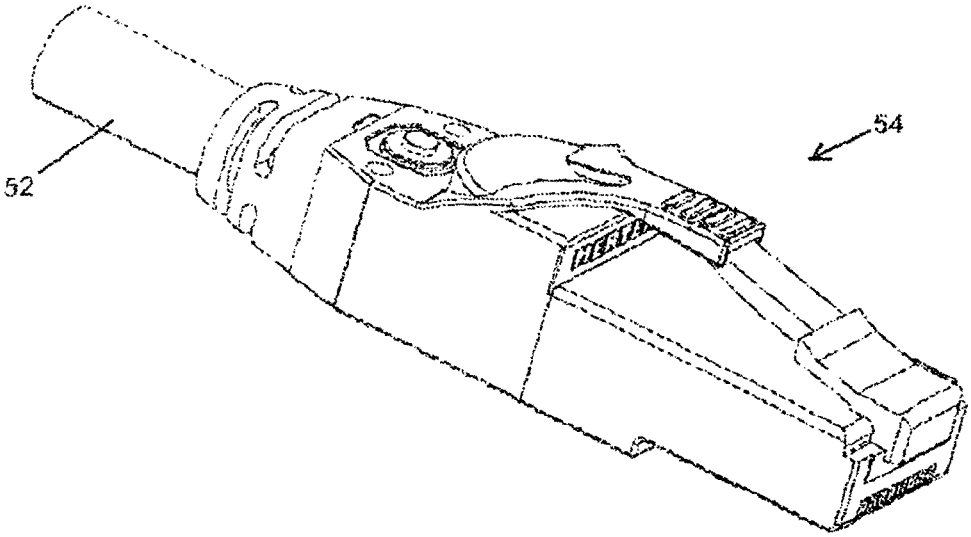

Once the tracer wires are coupled to the conductive tabs, conductors 90 can be threaded in pairs 90*a*, 90*b*, 90*c*, 90*d* through the respective channels 78, 80, 82, 84 of separator 76, and projections 86 of separator 76 can be inserted into the corresponding openings 88 in boot 58. As shown in FIG. 7D, lateral channels 80, 84 of separator 76 are configured to receive conductive tabs 66*a*, 66*b* to further stabilize conductive tabs 66*a*, 66*b* and separator 76. Next, plug 56 is disposed over separator 76 and a projecting portion 94 of boot 58, and conductors 90 are threaded through openings 96 in a distal end of plug 56, with each of openings 96 corresponding to a different one of contact blades 98. Contact blades 98 can then be pressed or crimped in direction 100 (upwards relative to the depicted orientation of plug 56) such that each of contact blades 98 cuts through an insulating layer of one of conductors 90 and is seated in plug 96 such that the contact blades are in contact with the conductive cores of the respective conductors 90 and are positioned (FIG. 7F) to contact corresponding conductive contacts in an RJ45 jack or port when plug 56 is inserted into such a jack or port. Conductors 90 can then be cut off flush or even with the distal end of plug 56. In other embodiments, separator 76 may be unitary with plug or connector 56 such that as conductors 90 can be simultaneously threaded through separator 76 and openings 96, or separator 76 may be omitted. In other embodiments, openings 96 can be omitted such that conductors 90 are cut to an appropriate length and inserted into plug 56 and the conductors need not be cut again after they are inserted into plug or connector 56. A retainer 102 of plug 56 can also be pressed or crimped in direction 104 inward relative to plug 56 such that retainer 102 extends into a corresponding groove or seat 106 in projecting portion 94 of boot (and a groove or seat 108 in conductive tabs 66*a*, 66*b*). Various crimping tools and/or machines are available for crimping contact blades 98 and retainer 102, such as those depicted in FIG. 10. FIG. 7G depicts cable 52 and connection hood 54 after the connection hood is applied to the cable.

Figure 8:
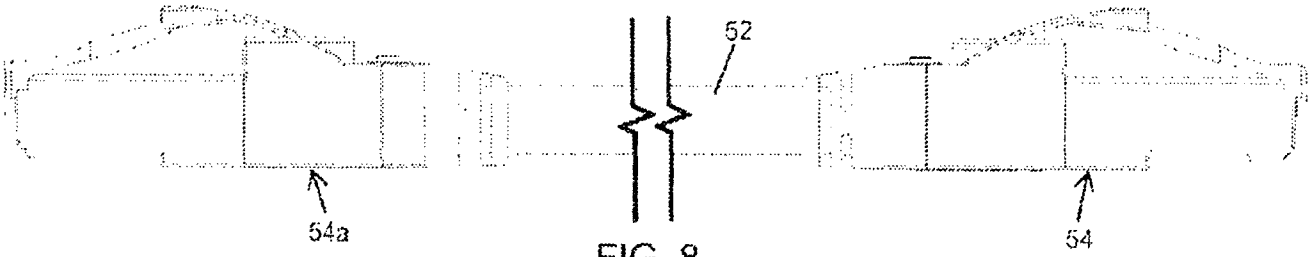
FIG. 8 depicts a side view of a field-terminated networking cable with two connection hoods of FIG. 3 connected via the steps illustrated in FIGS. 7A-7G.

FIG. 8 depicts a field-terminated networking cable having a first master connection hood 54 on a first end and a second slave connection hood 54*a* on a second end. As described above, slave connection hood 54*a* does not include a battery or controller, such that the battery of master connection hood 54 provides power to slave connection hood 54*a*, and the controller of master connection hood 54 controls the functionality (e.g., any combination of functions described above) of the indicator circuit between the two connection hoods via tracer wires 92*a*, 92*b* and the resulting activation of the telltales of both connection hoods. For example, if the indicator circuit and telltales are not active, then depression of the button of either connection hood can activate both telltales; and if the indicator circuit and telltales are active, then depression of the button of either connection hood inactivate both telltales. In other embodiments, the field-terminated cable can include two master connection hoods 54 with their respective controllers configured to provide the functionalized described in this disclosure (e.g., via inter-controller communication or independent operation of the controllers).

Figure 9:
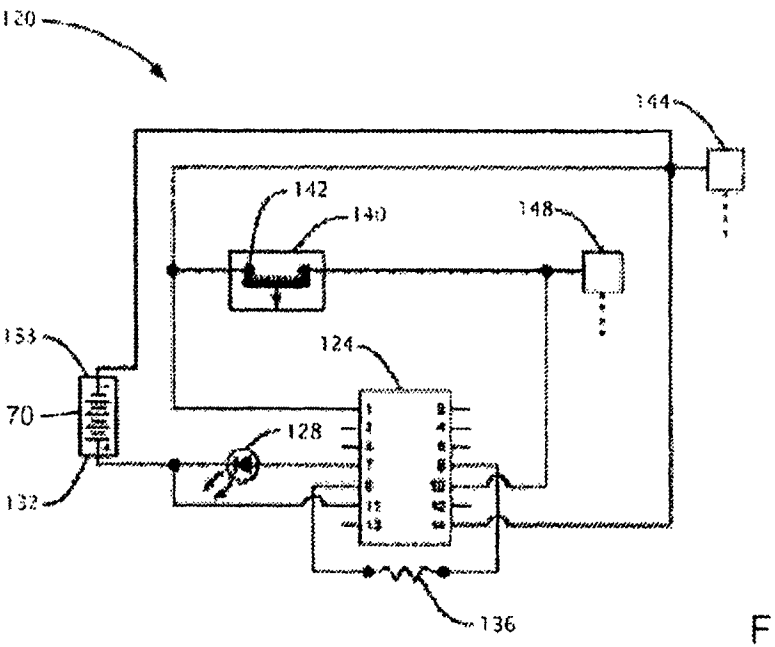
FIG. 9 depicts a schematic view of an embodiment of a control circuit for a master version of the connection hood of FIG. 3.

FIG. 9 depicts a schematic of one embodiment 120 of a direct current (DC) circuit for a connection hood of the present cables. An integrated circuit 124 is shown as an example of a controller 74 (FIG. 4). A light emitting diode (LED) 128 is shown as an example of a telltale 60. In the embodiment shown, LED 128 is in electrical connection with pin 7 of chip 124 and a first or positive connection 132 of battery 70, as well as with pin 11 of chip 124 via the connection between LED 128 and battery 70. Resistor 136 is connected across pins 8 and 9 of chip 124, and is configured to determine the frequency and duration of power pulses sent to LED 128. For example with an X1622 IC chip (available from Fulikai Electronic Technologies (China)), a 220-ohm resistor 136 will deliver pulses that cause LED 128 to blink for about 19 seconds. A smaller resistor (resistor with lower resistance) will increase the frequency of blinking and shorten the total duration of blinking. In embodiments in which the controller (e.g., IC chip) is configured to activate the telltale(s) for one of two or more predetermined times depending on the manner in which a switch is operated, the circuit can include two or more resistors 136 (e.g., each with a different resistance) to provide different durations of activation for the telltale(s). A switch 140 is shown as an example of switch 64 (FIG. 5) is operable to start the pulsing of power to the LED for the prescribed or predetermined amount of time. The ground or negative side 133 of battery 70 is connected to a first side 142 of switch 140, as well as pins 1 and 14 of integrated circuit 124. Finally, circuit 120 is connected to an indicator wire pair (tracer wires 92*a*, 92*b*) with conductors 144 and 148 that may be or may be connected to conductive tabs 66*a*, 66*b*. Conductors 144 and 148 can connect to a second circuit in the second connector hood via tracer wires 66*a*, 66*b*, and as discussed above, the second circuit can be identical to or may differ from circuit 120, as long as when a switch (e.g., 140) on either end is engaged, both telltales are activated.

In some embodiments, the present connection hoods can include one or more components alternative to or in addition to a battery (e.g., one or more capacitors). In some embodiments, the present connection hoods can be configured such that if electrically connected to power-over-Ethernet (POE) power sourcing equipment (PSE) (e.g., via en Ethernet jack or port), the PSE will deliver electric power to the connection hood even if not also electrically-connected to a separate POE-powered device (PD). For example, in some embodiments, the connection hood can comprise a resistor (which may be referred to as a POE resistor) incorporated into at least one of the connector hoods, the resistor being electrically connected to at least one of the conductive tabs (e.g., between connections 144 and 148 in circuit 120) such that if the connection hood is electrically connected to POE PSE, the PSE will deliver electric power to the cable even if not also electrically connected to a separate POE PD. Such a resistor can be of any suitable resistance (e.g., 25 k) as required by one or more POE standards.

POE delivery generally includes a "handshake" or initiation process with an exchange of signals between the PSE and a PSD in which the PSE verifies that the PD is standard compliant and determines the maximum amount of power to be delivered to the PD. In general, once the handshake is completed and the PSE begins delivering power to the PD, the PSE will stop delivering power to the PD if the PD stops drawing power for a predetermined period of time (e.g., 100 seconds). In embodiments in which the connection hood is configured to demand POE power even if not connected to an external PD, the connection hood can include any suitable configuration capable of performing the initial "handshake" or initiation process with the PSE. For example, in some embodiments, the connection hood can be configured to demand an initial burst or relatively higher amount of power to set the maximum power level from the PSE relatively high (e.g., 1 W) and then maintain at least a minimal or relatively lower power demand (e.g., 0.01 W) continuously to ensure that the PSE does not stop delivering power to the connection hood. For example, in embodiments with a battery, the connection hood can be configured to (e.g., after the handshake process) only demand power above the minimal power level from the PSE if the battery is below a threshold value and is being charged, but to demand at least the minimal power level from the PSE even when the battery is not being charged to ensure the constant availability of power from the PSE. For example, one or both connector hoods can include an appropriate POE circuit (such as may be included in POE powered devices) incorporated into and/or in communication with the circuit that provides the tracing functionality described in this disclosure. In other embodiments, the connection hood is not configured to maintain a minimal power demand from the PSE after the handshake is completed, such that the connection hood will fully charge the battery when plugged in, but then allow the PSE to stop delivering power once the battery is fully charged.

In some embodiments, the connection hood comprises a charging circuit coupled to the at least one of the conductor wire pairs (to which the POE resistor is coupled) and configured such that if the connection hood is electrically connected to POE PSE, the charging circuit can communicate electric current from the PSE to the power source (e.g., a rechargeable battery, a capacitor, etc.). In some embodiments, the POE resistor is included in a PCB to which the controller is coupled. In some embodiments, the controller is configured such that if the connection hood is electrically connected to POE PSE, the controller can direct electrical current from the PSE (or, more specifically, the POE PSE) to the battery (e.g., if the battery falls below a threshold voltage, such as, for example, 60% of the battery's rated voltage). In some embodiments, the controller is configured to only direct electrical current from the POE PSE if the battery is below the threshold voltage. In such embodiments, the circuit (e.g., similar to circuit 120) can include a suitable charging subcircuit, as is known in the art.

In some embodiments, a Radio Frequency Identification circuit, often called an RFID tag, replaces or supplements integrated circuit or controller 74. The use of an RFID tag can, for example, store information about a device to which one or both ends of a cable having the present connection hoods is connected, such as, for example, one or more of: the Media Access Control address (MAC address), the jack number, port address, IP address, workstation identifier, server identifier, and/or the other information. The user can then use an RFID reader to scan an end of the networking cable to obtain information about the location at which the opposite end of the cable is coupled without having to physically search for the other end of the cable. In some embodiments, master versions (e.g., 54) of the present connection hoods can have one or more components (e.g., button 62) of a first color (e.g., red) and slave versions (e.g., 54*a*) of the present connection hoods can have one or more components (e.g., button 62) of a second color (e.g., blue) that is different than the first color (e.g., to allow a user to readily distinguish between master and slave connection hoods.

Figure 10:
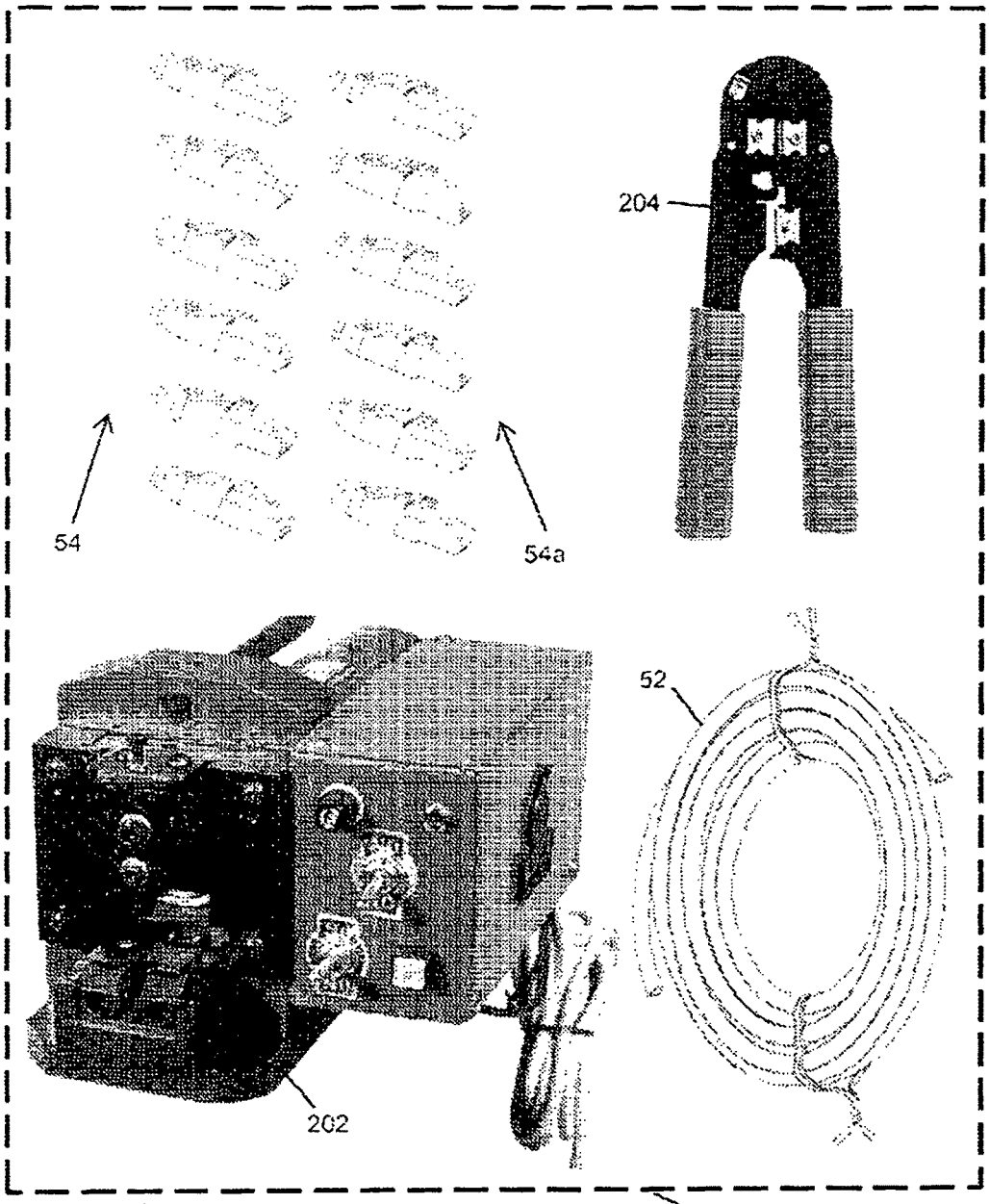
FIG. 10 depicts an embodiment of the present kits including a plurality of master versions of the connection hood of FIG. 3, a plurality of slave versions of the connection hood of FIG. 4, and certain tools for applying the connection hoods to networking cables.

FIG. 10 depicts an embodiment 200 of the present kits. In the embodiment shown, kit 200 comprises: a plurality of first (e.g., master) connection hoods 54; a plurality of second (e.g., master) connection hoods 54*a*; and a length (e.g., substantially equal to any one of or between any two of: 25 feet, 50 feet, 100 feet, 200 feet, 500 feet) of cable 52 without connection hoods (the cable having a plurality of conductors 90 and two tracer wires 92*a*, 92*b*). In the embodiment shown, kit 200 further comprises a powered crimper 202 configured to crimp at least a portion (e.g., connector blades 98) of the plug or connector 56 onto the plurality of conductors 90 (e.g., as described above). In the embodiment shown, kit 200 further comprises a non-powered hand tool 204 for stripping outer insulation of cable 52, cutting cable 52, and/or manually crimping at least a portion (e.g., connector blades 98) of the plug or connector 56 onto the plurality of conductors 90, depending on the particular configuration of the hand tool. Kit 200 may be disposed in a pouch, box, or case, as conceptually indicated by box 206.

The present embodiments of field-applicable connection hoods, kits, and methods permit a user to apply connection hoods to both ends of the cable, in the field (not in a dedicated assembly facility) and without soldering, to form a traceable networking cable of desired length.

The above specification and examples provide a complete description of the structure and use of exemplary embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present devices are not intended to be limited to the particular forms disclosed. Rather, they include all modifications and alternatives falling within the scope of the claims, and embodiments other than the one shown may include some or all of the features of the depicted embodiment. For example, components may be combined as a unitary structure (e.g., connector 56 and boot 58 may be formed as a unitary piece). Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A field-applicable connection hood for a cable, the connection hood comprising:

a connector or plug configured to be coupled to a port or outlet;

two conductive members each configured to be coupled without soldering to a tracer wire to enable electrical communication between the tracer wire and the conductive member, where the two conductive members each comprises a conductive tab with a slot configured to cut through an insulating layer of the tracer wire to contact a conductive core of the tracer wire such that the tracer wire can be coupled to the conductive tab without first stripping the insulating layer from the tracer wire;

an electrically activated telltale; and a switch configured to be actuated to enable electrical communication between the two conductive members and the telltale.

2. The connection hood of claim 1, where the switch is further configured to be actuated to disable electrical communication between the two conductive members and the telltale if the telltale is active.

3. The connection hood of claim 1, where the telltale is configured to emit an audio or visual signal if activated.

4. The connection hood of claim 3, where the telltale comprises one or more items selected from the group consisting of: a light emitting diode, an incandescent light bulb, and a liquid crystal visual indicator.

5. The connection hood of claim 1, further comprising:

a boot carrying the conductive members, the telltale, and the switch, the boot configured to be coupled to the plug or connector.

6. The connection hood of claim 1, further comprising:

a separator mechanism configured to separate at the plug or connector at least one of a plurality of conductors in a cable from at least one other of the plurality of conducts to prevent crosstalk between the separated conductors.

7. The connection hood of claim 1, further comprising:

an electric circuit element configured to electrically couple the two conductive members and the telltale responsive to the switch being operated.

8. The connection hood of claim 1, further comprising:

a controller configured to enable electrical communication between the two conductive members responsive to the switch being operated.

9. The connection hood of claim 8, where the controller is configured to periodically enable electrical communication between to the two conductive members.

10. The connection hood of claim 8, where the controller is configured to be powered through the tracer wires.

11. The connection hood of claim 10, further comprising:

a battery coupled to the controller;

where the controller is configured to electrically couple the two conductive members to the battery.

12. The connection hood of claim 11, where the controller is configured to:

enable electrical communication between the two conductive members through the battery responsive to the switch being operated if electrical communication is not already enabled; and interrupt electrical communication between the two conductive members through the battery responsive to the switch being operated if electrical communication is already enabled.

13. The connection hood of claim 11, where the controller is configured to interrupt communication through the battery between the two conductive members if a separate circuit between the two conductive members is interrupted.

14. The connection hood of claim 1, further comprising:

a boot carrying the conductive members, the telltale, and the switch, where each of the two conductive members extends beyond an end of the boot.

15. A cable comprising:

a cable having a plurality of conductors and two tracer wires;

a first connection hood coupled to a first end of the cable, the first connection hood comprising:

a connector or plug configured to be coupled to a port or outlet;

two conductive members each coupled without soldering to one of the tracer wires to enable electrical communication between the tracer wire and the conductive member;

an electrically activated telltale;

a switch configured to be actuated to enable electrical communication between the two conductive members of the first connection hood and the telltale of the first connection hood;

a second connection hood coupled to a second end of the cable, the second connection hood comprising:

a connector or plug configured to be coupled to a port or outlet;

two conductive members each coupled without soldering to one of the tracer wires to enable electrical communication between the tracer wire and the conductive member;

an electrically activated telltale;

a switch configured to be actuated to enable electrical communication between the two conductive members of the second connection hood and the telltale of the second connection hood; and a controller configured to enable electrical communication between the two conductive members of the second connection hood responsive to the switch being operated, where the two conductive members of the first connection hood or the two conductive members of the second connection hood each comprises a conductive tab with a slot configured to cut through an insulating layer of the tracer wire to contact a conductive core of the tracer wire such that the tracer wire can be coupled to the conductive tab without first stripping the insulating layer from the tracer wire.

16. A kit comprising:

a plurality of first connection hoods each comprising:

a connector or plug configured to be coupled to a port or outlet;

two conductive members each configured to be coupled without soldering to a tracer wire to enable electrical communication between the tracer wire and the conductive member;

an electrically activated telltale; and a switch configured to be actuated to enable electrical communication between the two conductive members and the telltale;

a plurality of second connection hoods each comprising:

a connector or plug configured to be coupled to a port or outlet;

two conductive members each configured to be coupled without soldering to a tracer wire to enable electrical communication between the tracer wire and the conductive member;

an electrically activated telltale;

a switch configured to be actuated to enable electrical communication between the two conductive members and the telltale; and a controller configured to enable electrical communication between the two conductive members responsive to the switch being operated; and a length of cable without connection hoods, the cable having a plurality of conductors and two tracer wires, where the two conductive members of each of the plurality of first connection hoods or the two conductive members of each of the plurality of second connection hoods each comprises a conductive tab with a slot configured to cut through an insulating layer of the tracer wire to contact a conductive core of the tracer wire such that the tracer wire can be coupled to the conductive tab without first stripping the insulating layer from the tracer wire.

17. The kit of claim 16, further comprising:

a crimper configured to crimp at least a portion of the plug or connector onto the plurality of conductors.

18. A method comprising:

coupling without soldering two tracer wires of a cable to two conductive members of a first connection hood comprising:

a connector or plug configured to be coupled to a port or outlet;

the two conductive members each configured to be coupled without soldering to a tracer wire to enable electrical communication between the tracer wire and the conductive member;

an electrically activated telltale; and a switch configured to be actuated to enable electrical communication between the two conductive members and the electrically activated telltale; and coupling without soldering the two tracer wires to two conductive members of a second connection hood comprising:

a connector or plug configured to be coupled to a port or outlet;

the two conductive members each configured to be coupled without soldering to a tracer wire to enable electrical communication between the tracer wire and the conductive member;

an electrically activated telltale;

a switch configured to be actuated to enable electrical communication between the two conductive members and the telltale; and a controller configured to enable electrical communication between the two conductive members responsive to the switch being operated;

where the two conductive members of the first connection hood or the two conductive members of the second connection hood each comprises a conductive tab with a slot configured to cut through an insulating layer of the tracer wire to contact a conductive core of the tracer wire such that the tracer wire can be coupled to the conductive tab without first stripping the insulating layer from the tracer wire.

19. The method of claim 18, where the tracer wires each includes a conductive core and an outer insulating layer, and the insulating layer is not removed prior to coupling the two tracer wires to the conductive members of the respective first and second connection hoods.

20. The method of claim 18, further comprising:

disposing a plurality of conductors of the cable in the plug or connector; and crimping at least a portion of the plug or connector onto the plurality of conductors.

* * * * *